US005244862A

United States Patent [19]

Bailey

[11] Patent Number: 5,244,862

[45] Date of Patent: Sep. 14, 1993

[54] THERMAL DYE TRANSFER RECEIVING ELEMENT WITH MODIFIED BISPHENOL-A EPICHLOROHYDRIN POLYMER DYE-IMAGE RECEIVING LAYER

[76] Inventor: David B. Bailey, Eastman Kodak Company, Rochester, N.Y. 14650-2201

[21] Appl. No.: 922,938

[22] Filed: Jul. 31, 1992

[51] Int. Cl.[5] ..... B41M 5/035; B41M 5/38

[52] U.S. Cl. ..... 503/227; 428/195; 428/913; 428/914

[58] Field of Search ..... 503/227; 428/195, 913, 428/914

[56] References Cited

U.S. PATENT DOCUMENTS 4,695,286 9/1987 Vanier et al. ..... 8/471
4,927,803 5/1990 Bailey et al. ..... 503/227

FOREIGN PATENT DOCUMENTS 0228301 7/1987 European Pat. Off. ..... 503/227
61-258792 11/1986 Japan ..... 503/227
2-106393 4/1990 Japan ..... 503/227

*Primary Examiner*—Pamela R. Schwartz
*Attorney, Agent, or Firm*—Andrew J. Anderson

[57] ABSTRACT

A dye-receiving element for thermal dye transfer includes a support having on one side thereof a dye image-receiving layer. Receiving elements of the invention are characterized in that the dye image-receiving layer comprises a linear phenoxy resin substantially free of free hydroxyl groups obtained by blocking free hydroxyl groups on a phenoxy resin derived from bisphenol-A and epichlorohydrin with ester, amide, ether, or silyl ether groups.

9 Claims, No Drawings

THERMAL DYE TRANSFER RECEIVING ELEMENT WITH MODIFIED BISPHENOL-A EPICHLOROHYDRIN POLYMER DYE-IMAGE RECEIVING LAYER

This invention relates to dye-receiving elements used in thermal dye transfer, and more particularly to polymeric dye image-receiving layers for such elements.

In recent years, thermal transfer systems have been developed to obtain prints from pictures which have been generated electronically from a color video camera. According to one way of obtaining such prints, an electronic picture is first subjected to color separation by color filters The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen for its compatibility and receptivity for the dyes to be transferred from the dye donor element.

Phenoxy resins have been disclosed for use in dye-receiving layers (such as disclosed in Japanese Kokai 61-258792 (May 15, 1985) which describes silicone polymer overcoats on a variety of receiver, polymers, one which appears to be a bisphenol-A epichlorohydrin). Phenoxy resins derived from bisphenol-A and epichlorohydrin (such Union Carbide UCAR® PK Series Phenoxy Resins) are readily available and relatively inexpensive polymers compared to many other receiving layer polymers. While such polymers generally have good dye up-take properties when used for thermal dye transfer, they contain free hydroxyl groups and exhibit severe fade when the dye images are subjected to high intensity daylight illumination. Japanese Kokai 02-106393 (Oct. 17, 1988) describes phenoxy resins modified with the partial hydrolysate of multifunctional silane coupling agents, but does not propose any other modifying agents. Polycarbonate polymers and copolymers have been disclosed (such as in U.S. Pat. Nos. 4,695,286 and 4,927,803) for thermal dye transfer which have improved image stability, but such polymers are relatively expensive.

It would be highly desirable to provide an inexpensive receiver element for thermal dye transfer processes having excellent dye uptake and image stability having a dye-receiving layer based upon commercially available phenoxy resins.

These and other objects are achieved in accordance with this invention which comprises a dye-receiving element for thermal dye transfer comprising a support having on one side thereof a dye image-receiving layer, wherein the dye image-receiving layer comprises a linear phenoxy resin substantially free of free hydroxyl groups obtained by blocking the free hydroxyl groups on a phenoxy resin derived from bisphenol-A and epichlorohydrin.

Phenoxy polymers (e.g., commercially available UCAR® PK Series Phenoxy Resins from Union Carbide) derived from bisphenol-A and epichlorohydrin that contain free hydroxyl groups are described by the following structure:

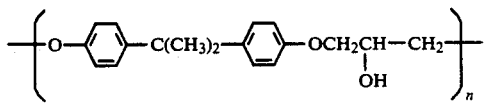

Functionalization of the hydroxyl groups of the bisphenol-A epichlorohydrin derived polymer significantly alters its properties and produces a markedly different material A variety of reactants may be used to modify the bisphenol-A epichlorohydrin derived polymer and form a linear polymer of the following structure having ester, amide, ether, or silyl ether groups in place of the free hydroxyl groups:

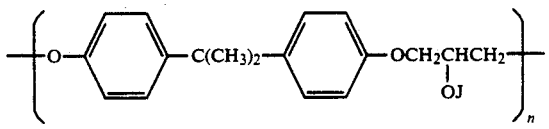

where J is $-C(O)R^1$, $-C(O)NHR^2$, $-C(O)NR^2R^3$, $-CHR^4OR^5$, or $-SiR^1R^2R^3$, and $R^1$, $R^2$, $R^3$, $R^4$, and $R^5$ are substituted or unsubstituted alkyl, aryl or cycloalkyl groups such as: $-CH_3$—$CH_2Cl$, $-CH_2OCH_3$, $-CH_2CH_3$, $-CH(CH_3)_2$, $-C_4H_9$—n, $-C_5H_{11}$—n, $-C_8H_{17}$—n, $-CH(C_2H_5)_2$, $-C_6H_{11}$—c, $-CH_2CH_2C_6H_5$, $-CH_2CH(C_6H_5)_2$, $-CH_2OCH_2C_6H_5$, $-CH_2CH_2C_6H_3$ (3,4—$OCH_3$), $-CH_2CO_2C_2H_5$, $-C_6H_5$, $-C_6H_4$(p—$C_5H_{11}$), $-C_6H_4$(p—$OC_5H_{11}$), and $-C_6H_4$(p—$C_{10}H_{21}$). $R^4$ and $R^5$ may also optionally join together to form a heterocycle. When J is $-SiR^1R^2R^3$, $R^1$, $R^2$, and $R^3$ are preferably chosen from methyl and phenyl groups.

For the purposes of this invention, a polymer derived from bisphenol-A and epichlorohydrin is considered to be "substantially free of free hydroxyl groups" when at least 50% of the polymer units derived from epichlorohydrin do not contain free hydroxyl groups. Preferably, at least 75% of such units, and more preferably at least 95% of such units, will have their free hydroxyl groups blocked.

Examples of particular polymers of the invention according to the above formula include E-1 through E-19, which are obtained by blocking the free hydroxyl groups of UCAR® PKHH Phenoxy Resin:

| Polymer | J | Tg |
|---|---|---|
| E-1 | $COC_2H_5$ | 61° C. |
| E-2 | $COC_5H_{11}$ | 33° C. |
| E-3 | $COCH(C_2H_5)_2$ | 48° C. |
| E-4 | $COC_6H_{11}$-c | 73° C. |
| E-5 | $COCH_2CH_2C_6H_5$ | 49° C. |
| E-6 | $COCH_2CH(C_6H_5)_2$ | 77° C. |
| E-7 | $COCH_2OCH_2C_6H_5$ | 43° C. |
| E-8 | $COCH_2CH_2C_6H_3(3,4\text{-}OCH_3)$ | 49° C. |
| E-9 | $COC_6H_5$ | 84° C. |
| E-10 | $COC_6H_4$-p-($C_5H_{11}$-n) | 58° C. |
| E-11 | $COC_6H_4$-p-($OC_5H_{11}$-n) | 63° C. |
| E-12 | $COC_6H_4$-p-($C_{10}H_{21}$-n) | 32° C. |
| E-13 | $CONHC_4H_9$-n | 70° C. |
| E-14 | $CONHC_6H_{13}$-n | 57° C. |
| E-15 | $CONHC_8H_{17}$-n | 46° C. |
| E-16 | $CONHCH_2CO_2C_2H_5$ | 66° C. |
| E-17 | 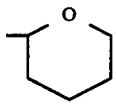 | 74° C. |
| E-18 | $Si(CH_3)_2(C_6H_5)$ | 43° C. |
| E-19 | $Si(CH_3)(C_6H_5)_2$ | 32° C. |

The polymers of the invention give improved dye stability as compared to the non-functionalized polymer containing free hydroxyl groups, and compared to bisphenol-A polycarbonate.

Polymers are preferred that have a glass transition temperature, Tg, of greater than 25° C., and more preferably between 25 and 100° C. Preferred number molecular weights for the polymers of the invention are from about 5,000 to about 300,000, more preferably from 30,000 to 100,000.

The support for the dye-receiving element of the invention may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference.

The invention polymers may be used in a receiving layer alone or in combination with other receiving layer polymers. The polymers may be used in the receiving layer itself, or in an overcoat layer. The use of overcoat layers is described in U.S. Pat. No. 4,775,657, the disclosure of which is incorporated by reference. Receiving layer polymers which may be overcoated or blended with the polymers of the invention include polycarbonates, polyurethanes, acrylonitrile), poly(caprolactone) or any other receiver polymer and mixtures thereof.

The dye image-receiving and overcoat layers may be present in any amount which is effective for their intended purposes. In general, good results have been obtained at a receiver layer concentration of from about 0.5 to about 10 g/m$^2$ and an overcoat layer concentration of from about 0.01 to about 3.0 g/m$^2$, preferably from about 0.1 to about 1 g/m$^2$.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated The third color is obtained in the same manner.

The following examples are provided to further illustrate the invention. The synthesis example is representative, and other polymers of the invention may be prepared analogously or by other methods know in the art.

Synthesis: Preparation of E-1, the propionate ester of a polymer of bisphenol-A and epichlorhydrin UCAR® PKNN (phenoxy resin from Union Carbide) (10 g, 35.2 mmoles free hydroxyl groups) was reacted with propionyl chloride (6.5 g, 70 mmoles) in tetrahydrofuran (40 ml). Triethylamine (7.5 g, 75 mmoles) was added and the solution was refluxed under argon for 2 hours. The solution was precipitated by pouring into methanol (500 ml). Two more precipitations were made by redissolving the polymer in tetrahydrofuran (100 ml) and pouring into methanol, after which the product E-1 was filtered and air dried. The yield was 11.3 g (95%).

The other derivatives E-2 through E-19 of the commercial phenoxy resin polymer of the examples were prepared in similar manner to polymer E-1 using the corresponding desired acyl chloride or silylchloride.

EXAMPLE

Dye-receiver elements were prepared by coating the following layers in order on white-reflective supports of titanium dioxide pigmented polyethylene overcoated paper stock:

(1) Subbing layer of poly(acrylonitrile-covinylidene chloride-co-acrylic acid) (14:79:7 wt. ratio) (0.08 g/m$^2$) from butanone.

(2) Dye-receiving layer of the indicated invention (E-1 through E-19) or control (C-1 and C-2) polymer (3.0 g/m$^2$) containing Fluorad FC-431 dispersant (3M Corp) (0.008 g/m$^2$). Invention polymers were coated from dichloromethane or butanone; control polymers were coated from a dichloromethane and tetrahydrofuran solvent mixture.

Two control dye-receivers were coated. C-1 is the non-functionalized polymer with free hydroxyl groups (Tg=100° C.). C-2 is bisphenol-A polycarbonate (Tg=160° C.), a well known prior art receiver polymer.

Yellow dye-donor elements were prepared by coating the following layers in order on a 6 μm poly(ethylene terephthalate) support:

(1) Subbing layer of Tyzor TBT (titanium tetra-n-butoxide) (duPont Co.) (0.12 g/m$^2$) from a n-propyl acetate and 1-butanol solvent mixture.

(2) Dye-layer containing the yellow dye illustrated below (0.19 g/m$^2$) and S-363N1 (a micronized blend of polyethylene, polypropylene and oxidized polyethylene particles) (Shamrock Technologies, Inc.) (0.02 g/m$^2$) in a cellulose acetate propionate binder (2.5% acetyl, 46% propionyl) (0.44 g/m$^2$) from a toluene, methanol, and cyclopentanone solvent mixture.

On the reverse side of the support was coated a titanium alkoxide subbing layer as described above on top of which was coated a backing (slipping layer) similar to those described in Example 1 of U.S. Pat. No. 4,892,860.

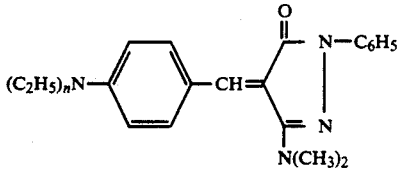

(Yellow Dye)

Magenta dye-donor elements were prepared as described above except the dye layer contained a mixture of the two magenta dyes illustrated below (0.11 g/m$^2$ and 0.12 g/m$^2$) and the binder was adjusted (0.40 g/m$^2$).

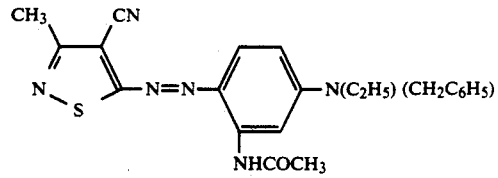

(Magenta Dye 1)

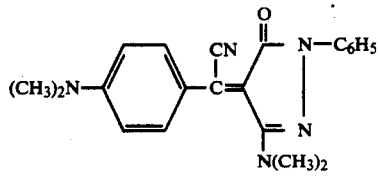

(Magenta Dye 2)

The dye side of a yellow dye-donor element approximately 10 cm×15 cm in area was placed in contact with the polymeric receiving layer side of the dye-receiver element of the same area. The assemblage was fastened to the top of a motor-driven 60 mm diameter rubber roller and a TDK Thermal Head L-231, thermostated at 26° C., was pressed with a spring at a force of 36 Newtons against the dye-donor element side of the assemblage pushing it against the rubber roller.

The imaging electronics were activated and the assemblage was drawn between the printing head and roller at 31 mm/sec. Coincidentally, the resistive elements in the thermal print head were pulsed at 156 μsec intervals (127 μsec/pulse) during the 5 msec/dot printing time. The voltage supplied to the print head was approximately 20v resulting in an instantaneous peak power of approximately 0.27 watts/dot and a maximum total energy of 8.1 mjoules/dot. A stepped density image was generated by incrementally increasing the pulses/dot through a defined range to a maximum of 32.

Magenta dye-donors were printed in the same manner. The Status-A Blue and Green reflection densities of the printed dyes at maximum density, Dmax, were read and recorded.

The step of each yellow or magenta dye image nearest a density of 1.0 was then subjected to exposure for 1 week, 50 kLux, 5400° K., approximately 25% RH. The Status A Blue and Green reflection densities were compared before and after fade and the percent density loss was calculated.

| | BLUE DENSITY | | GREEN DENSITY | |
|---|---|---|---|---|
| Polymer | D-max | % Loss | D-max | % Loss |
| C-1 | 2.4 | 24 | 2.6 | 84 |
| C-2 | 2.6 | 49 | 2.7 | 79 |
| E-1 | 2.7 | 9 | 2.6 | 38 |
| E-2 | 2.5 | 9 | 2.6 | 20 |
| E-3 | 2.5 | 9 | 2.6 | 22 |
| E-4 | 2.5 | 11 | 2.6 | 40 |
| E-5 | 2.3 | 7 | 2.5 | 34 |
| E-6 | 2.2 | 11 | 2 4 | 50 |
| E-7 | 2.4 | 7 | 2.6 | 35 |
| E-8 | 2.3 | 7 | 2.5 | 60 |
| E-9 | 2.4 | <2 | 2.5 | 61 |
| E-10 | 2.3 | <2 | 2.6 | 41 |
| E-11 | 2.3 | 10 | 2.5 | 55 |
| E-12 | 2.6 | 12 | 2.7 | 26 |
| E-13 | 2.3 | 10 | 2.5 | 29 |
| E-14 | 2.4 | 8 | 2.6 | 54 |
| E-15 | 2.5 | 12 | 2.6 | 50 |
| E-16 | 2.2 | 9 | 2.4 | 36 |
| E-17 | 2.4 | 11 | 2.6 | 53 |

-continued

| Polymer | BLUE DENSITY D-max | BLUE DENSITY % Loss | GREEN DENSITY D-max | GREEN DENSITY % Loss |
|---|---|---|---|---|
| E-18 | 2.6 | 4 | 2.7 | 15 |
| E-19 | 2.4 | 5 | 2.6 | 26 |

The data above show that the receiver polymers of the invention accept dye efficiently as shown by high maximum density (D-max values) and produce significantly less dye loss as compared to the control receiver polymers While the data for the invention polymers was obtained for derivatives of UCAR® PKHH (Union Carbide) phenoxy resin, derivatives UCAR® PKHC and PKHJ would be expected to give equivalent results in the practice of the invention as they differ only in viscosity from the medium viscosity PKHH material.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein the dye image-receiving layer comprises a linear phenoxy resin substantially free of free hydroxyl groups obtained by blocking free hydroxyl groups on a phenoxy resin derived from bisphenol-A and epichlorohydrin with ester, amide, ether, or silyl ether groups.

2. The element of claim 1, wherein the phenoxy resin substantially free of free hydroxyl groups is of the structure

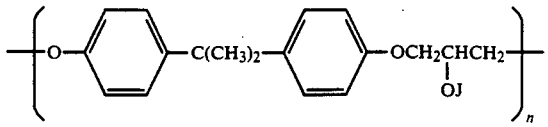

where J is $—C(O)R^1$, $—C(O)NHR^2$, $—C(O)NR^2R^3$, $—CHR^4OR^5$, or $—SiR^1R^2R^3$, and $R^1$, $R^2$, $R^3$, $R^4$, and $R^5$ are substituted or unsubstituted alkyl, aryl or cycloalkyl groups.

3. The element of claim 2, wherein J is $—C(O)R^1$.

4. The element of claim 2, wherein J is $—C(O)NHR^2$.

5. The element of claim 2, wherein J is $—C(O)NR^2R^3$.

6. The element of claim 2, wherein J is $—CHR^4OR^5$.

7. The element of claim 2, wherein J is $—SiR^1R^2R^3$.

8. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer comprises a linear phenoxy resin substantially free of free hydroxyl groups obtained by blocking free hydroxyl groups on a phenoxy resin derived from bisphenol-A and epichlorohydrin with ester, amide, ether, or silyl ether groups.

9. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein the dye image-receiving layer comprises a linear phenoxy resin substantially free of free hydroxyl groups obtained by blocking free hydroxyl groups on a phenoxy resin derived from bisphenol-A and epichlorohydrin with ester, amide, ether, or silyl ether groups.

* * * * *

UNITED STATES PATENT AND TRADEMARK OFFICE

CERTIFICATE OF CORRECTION

PATENT NO.: 5,244,862

DATED: September 14, 1993

INVENTOR(S): David B. Bailey

It is certified that error appears in the above-identified patent and that said Letters Patent is hereby corrected as shown below:

On the title page of the patent, "Item [76] Inventor: David B. Bailey, Eastman Kodak Company, Rochester, N.Y. 14650-2201", should read -- Item [75] Inventor: David B. Bailey, Webster, N.Y." and insert thereafter Signed and Sealed this Twenty-sixth Day of April, 1994

*Attest:*

*Attesting Officer*

BRUCE LEHMAN

*Commissioner of Patents and Trademarks*